US009639027B2

(12) United States Patent
He

(10) Patent No.: US 9,639,027 B2
(45) Date of Patent: May 2, 2017

(54) TONER CARTRIDGE

(71) Applicant: PRINT-RITE UNICORN IMAGE PRODUCTS CO., LTD. OF ZHUHAI, Guangdong (CN)

(72) Inventor: Yonggang He, Guangdong (CN)

(73) Assignee: Print-Rite • Unicorn Image Products Co., Ltd. of Zhuhai, Zhuhai, Guangdong (CN)

( * ) Notice: Subject to any disclaimer, the term of this patent is extended or adjusted under 35 U.S.C. 154(b) by 0 days.

(21) Appl. No.: 15/109,084

(22) PCT Filed: Nov. 13, 2014

(86) PCT No.: PCT/CN2014/090964
§ 371 (c)(1),
(2) Date: Jun. 29, 2016

(87) PCT Pub. No.: WO2015/101111
PCT Pub. Date: Jul. 9, 2015

(65) Prior Publication Data

US 2016/0320723 A1 Nov. 3, 2016

(30) Foreign Application Priority Data

Dec. 31, 2013 (CN) ..... 2013 2 0892731 U

(51) Int. Cl.
*G03G 15/08* (2006.01)
*G03G 21/12* (2006.01)
*G03G 21/18* (2006.01)

(52) U.S. Cl.
CPC ..... *G03G 15/0865* (2013.01); *G03G 21/12* (2013.01); *G03G 21/1803* (2013.01); *G03G 2221/0052* (2013.01)

(58) Field of Classification Search
CPC ..... G03G 15/0865; G03G 21/12; G03G 21/1803; G03G 2221/0052
(Continued)

(56) References Cited

U.S. PATENT DOCUMENTS 4,267,772 A * 5/1981 Maitland ..... B41K 3/54 101/103
7,177,577 B2 * 2/2007 Ishiguro ..... G03G 15/0868 399/120
(Continued)

FOREIGN PATENT DOCUMENTS

CN 201514546 6/2010
CN 201527545 7/2010
(Continued)

*Primary Examiner* — Susan Lee
(74) *Attorney, Agent, or Firm* — Cozen O'Connor

(57) ABSTRACT

The present invention relates a toner cartridge used for a laser printer. The toner cartridge comprises: a toner tank for storing fresh toner and a waste toner tank for storing waste toner obtained after development. When the toner cartridge is installed in a laser printer, the toner tank has a toner supplying section at a lower portion in a vertical direction thereof for supplying toner to an external environment. Two inner surfaces of the toner tank, arranged in a transverse direction of the toner tank and parallel with a direction in which the toner cartridge is installed into the laser printer, keep in a plane state at positions higher than the toner supplying section and are parallel with the vertical direction.

2 Claims, 3 Drawing Sheets

(58) Field of Classification Search
USPC ..... 399/120
See application file for complete search history.

(56) References Cited

U.S. PATENT DOCUMENTS

| | | | | |
|---|---|---|---|---|
| 7,395,015 | B2 * | 7/2008 | Ishiguro | G03G 15/0879 399/258 |
| 2008/0031658 | A1 * | 2/2008 | Okamoto | G03G 15/0884 399/262 |
| 2008/0063472 | A1 * | 3/2008 | Hickman | E01C 9/00 404/71 |
| 2010/0231662 | A1 * | 9/2010 | Ara | B41J 2/17509 347/85 |

FOREIGN PATENT DOCUMENTS

| | | |
|---|---|---|
| CN | 101846927 | 9/2010 |
| CN | 202362588 | 8/2012 |
| CN | 203232246 | 9/2013 |

* cited by examiner

TONER CARTRIDGE

PRIORITY CLAIM

This is a U.S. national stage of application No. PCT/CN2014/090964, filed on Nov. 13, 2014. Priority is claimed on Chinese Application No. CN201320892731.2 filed Dec. 31, 2013, the content of which is incorporated here by reference.

TECHNICAL FIELD

The present invention relates to a toner cartridge used in an electronic imaging/photographing device, and particularly to a toner cartridge used as a developer receiving device in a laser printer. The present invention claims the priority of the Chinese utility model patent application No. 201320892731.2 filed on Dec. 31, 2013, the content of which is incorporated herein in its entirety as closely related reference literature.

BACKGROUND ARTS

Referring to FIG. 1, the basic imaging process of a laser printer with a processing cartridge 100 as a core component is as below: a cylindrical surface of a photosensitive drum 101 is charged evenly by a charging roller 102; a laser scanner 103 emits a modulated laser beam 104 carrying image information to the cylindrical surface of the photosensitive drum 101; after illuminating by the laser beam 104, the cylindrical surface of the photosensitive drum 101 is formed with an uneven static charge distribution pattern, namely, an electrostatic latent image corresponding to an image to be copied; then, a developer, such as toner 106, which is conveyed by a developing roller 105 and whose layer thickness has been adjusted by a toner discharging blade 113, is attracted to the cylindrical surface of the photosensitive drum 101, converting the electrostatic latent image into a visible image visible to naked eyes by covering the same; as the photosensitive drum 101 rotates, the visible image formed on the surface of the photosensitive drum by the toner 106 is transferred to a transferring roller 107; by applying a transfer voltage carried by the transferring roller 107, toner in the form of the visible image is transferred to a surface of a recording medium 108 such as paper; after heating and pressing the toner in the form of the visible image on the recording medium 108 by a heating roller 111 and a pressing roller 112, the toner penetrates into fiber layers of the recording medium 108, so that the toner in the form of the visible image is solidified on the recording medium 108 permanently; after the visible image on the photosensitive drum 101 is transferred by the transferring roller 107, waste toner 109 attached to the photosensitive drum 101 is scraped into a waste toner collecting tank by a waste toner scraper 110; the surface of the photosensitive drum 101 is returned to a standby state free from electricity and toner after the static charges are removed by an electricity dissipation device. Thus, a basic imaging process is finished. By repeating the above process, images required by a user can be obtained.

TECHNICAL PROBLEMS

When the above laser printer is working, the toner is received in the toner cartridge and is supplied to the photosensitive drum via the toner cartridge. In case of color printing, usually the toner is further transported by the photosensitive drum to a transfer belt until it is fixed on the surface of the recording medium. The Chinese patent literature CN200910002278.1 discloses a laser printer, in which multicolor toner used by the laser printer is received and supplied by a number of toner cartridges corresponding to a number of the colors. The toner tank and the waste toner tank of the toner cartridge are two independent chambers sequentially arranged along a vertical direction. When the toner cartridge is installed in the laser printer, a toner inlet of the waste toner tank is located at an upper portion of the waste toner tank, and a toner outlet of the toner tank is located at a lower portion of the toner tank. As the upper portion of the toner tank is wider and does not include a toner transporting mechanism, usually the toner may be retained on side walls of the toner tank and cannot flow down. In addition, a top cap mounted with a chip is specially provided on a top wall of the toner tank of the toner cartridge, so that design of the toner cartridge is complex and it is difficult to perform secondary toner supply for the toner cartridge.

TECHNICAL SOLUTIONS

An object of the present invention is to provide a toner cartridge which can reduce the toner residual amount in a toner tank when supplying toner to improve the utilization efficiency of toner.

To realize the above object, the present invention provides a toner cartridge that comprises a toner tank for storing fresh toner and a waste toner tank for storing waste toner obtained after development. When the toner cartridge is installed in a laser printer, the toner tank has a toner supplying section at a lower portion in a vertical direction thereof for supplying toner to an external environment. Two inner surfaces of the toner tank, arranged in a transverse direction of the toner tank and parallel with a direction in which the toner cartridge is installed into the laser printer, keep in a plane state at positions higher than the toner supplying section and are parallel with the vertical direction.

An outer wall of the toner tank, arranged at an upper portion in the vertical direction of the toner tank and parallel with the direction in which the toner cartridge is installed into the laser printer, is provided with a holder for installing an integrated circuit board. A toner injecting port at a top wall of the toner tank, arranged at the upper portion in the vertical direction and parallel with the direction in which the toner cartridge is installed into the laser printer, directly connects a chamber of the toner tank and the external environment, and is sealed by a removable toner injecting cap.

ADVANTAGEOUS EFFECTS

The present invention solves the problem that a toner cartridge cannot be sufficiently utilized due to excessive residual toner left in a toner tank of the toner cartridge. In addition, by directly placing the integrated circuit board on the outer wall which is arranged at an upper portion in the vertical direction of the toner tank, and by adopting a structure with a top cap removed, the present invention can offer more space and expand a volume of the toner tank for storing toner.

PREFERRED EMBODIMENTS

The toner cartridge of the present invention is described in detail with reference to the accompanying drawings.

Figure 1:
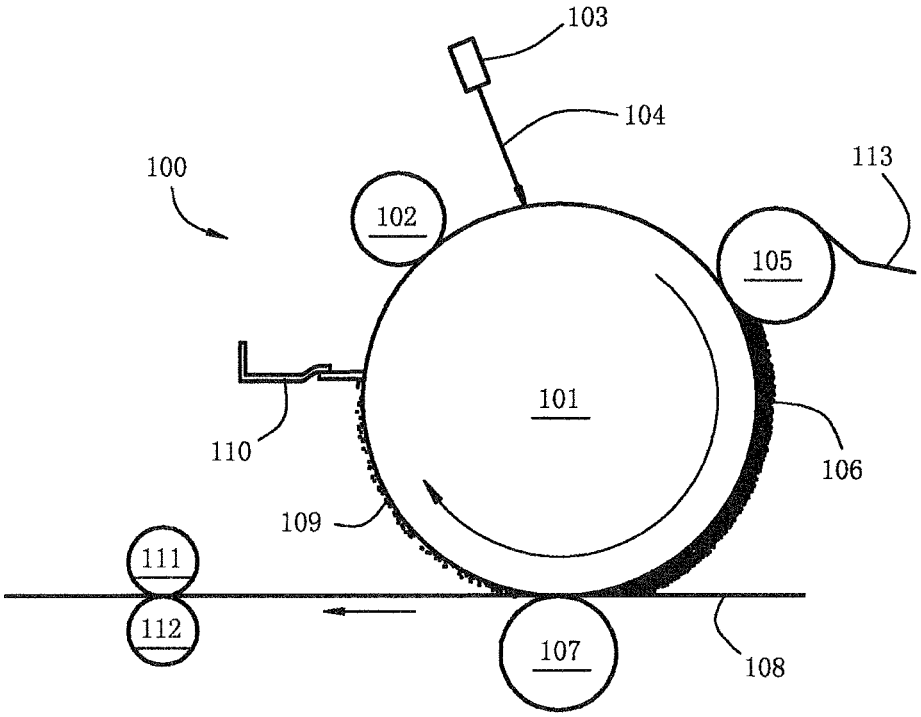
FIG. 1 is a schematic view showing a structure of an existing laser printer.
Figure 2:
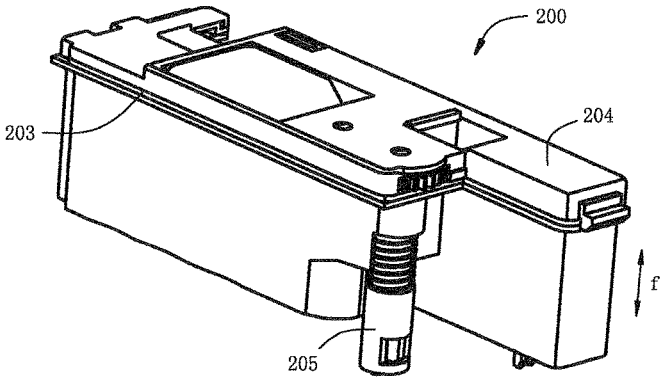
FIG. 2 is a perspective view of a toner cartridge of the present invention.
Figure 3:
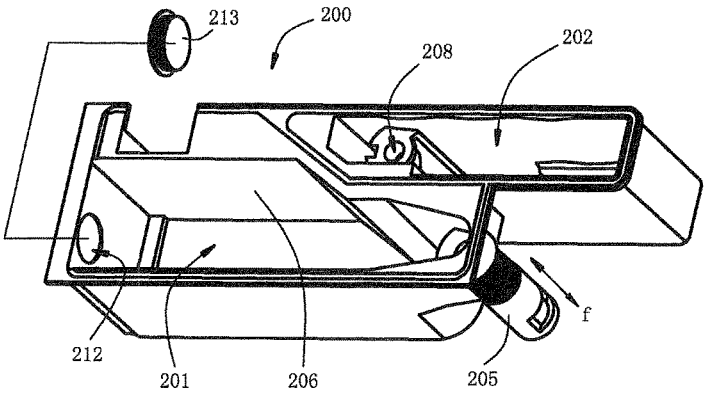
FIG. 3 is a first partially exploded perspective view of the toner cartridge of the present invention.
Figure 4:
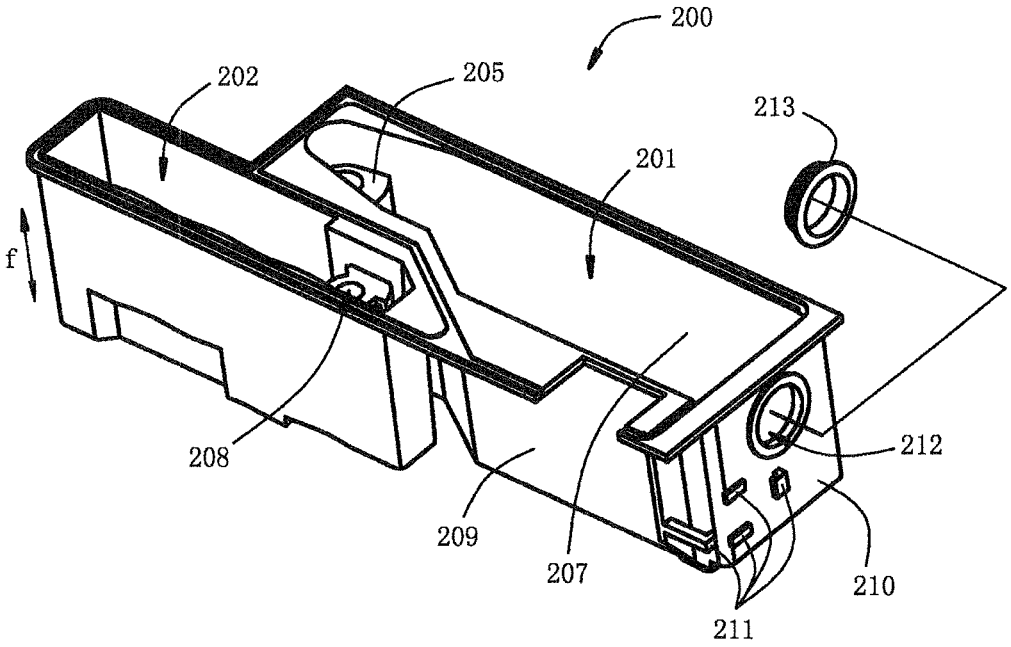
FIG. 4 is a second partially exploded perspective view of the toner cartridge of the present invention.

FIGS. 2-4 are perspective views of the toner cartridge of the present invention from different viewing angles and different assembled states.

The main structure of the toner cartridge of the present invention is basically the same as those of the toner cartridges of the identical or similar fields, and may be understood by those skilled in the art by referring to the related technical documents in the identical or similar fields and introduction in the Background Arts of this description.

The present invention intends to propose a suitable solution for the problem that a toner cartridge cannot be sufficiently utilized due to excessive residual toner left in a toner tank of the toner cartridge. The following descriptions will focus on the structures of the toner cartridge of the present invention that are related to improvement of the toner utilization efficiency.

Referring to FIGS. 1-4, components of a toner cartridge 200 comprise a toner tank 201 for storing fresh toner 106 and supplying the same to a developing roller 105 and a waste toner tank 202 for collecting waste toner 109.

The toner tank 201 and the waste toner tank 202 are two independent and sealed chambers. When the toner cartridge 200 is installed in a laser printer, the toner tank 201 is arranged at a position higher than the waste toner tank 202 in a vertical direction, but portions of the two tanks are overlapped in the vertical direction.

An inner cap 203 acts as tank walls of the toner tank 201 and the waste toner tank 202 opposite the laser printer in a direction f in which the toner cartridge 200 is installed into the laser printer. That is, before assembling, the area of the tank walls of the toner tank 201 and the waste toner tank 202 opposite the laser printer in the direction f are in an open state; and after assembling, the area of the tank walls of the toner tank 201 and the waste toner tank 202 opposite the laser printer in the direction f and in the open state are sealed by a single member---the inner cap 203. Other tank walls of the toner tank 201 and the waste toner tank 202 or tank walls of the toner tank 201 and the waste toner tank 202 in other directions are directly formed by plastic injection molding. After sealing the toner tank 201 and the waste toner tank 202, the inner cap 203 is encapsulated by an outer cap 204 along an outer side of the direction f. To be specific, after the inner cap 203 seals the toner tank 201 and the waste toner tank 202, the outer cap 204 is placed on the inner cap 203. Thus, after the toner cartridge 200 is installed, only the outer cap 204 can be seen, and the inner cap 203 cannot be seen, or only a portion of the inner cap 203 can be seen.

When the toner cartridge 200 is installed in the laser printer, a toner supplying section 205 is provided at a lower portion of the toner tank 201 in the vertical direction for communicating with a chamber of the toner tank 201 and supplying toner to an external environment. When the toner cartridge 200 is installed in the laser printer, a waste toner inlet 208 is provided at an upper portion of the waste toner tank 202 in the vertical direction for communicating with a chamber of the waste toner tank 202 and allowing waste toner obtained after development to flow into the chamber of the waste toner tank 202. Two inner surfaces 206, 207 of the toner tank 201, arranged in a transverse or horizontal direction of the toner tank 201 and parallel with the direction f in which the toner cartridge 200 is installed into the laser printer, keep in a plane state at positions higher than the toner supplying section 205, and the two planes are parallel with the vertical direction. When the toner cartridge 200 is installed in the laser printer, a projection on the horizontal plane of an outer wall 209 of the toner tank 201 which is close to the waste toner tank 202 in the transverse or horizontal direction is staggered relative to the waste toner inlet 208. When the toner cartridge 200 is installed in the laser printer, an outer wall or top wall 210 of the toner tank 201, arranged at an upper portion in the vertical direction and parallel with the direction f in which the toner cartridge 200 is installed into the laser printer, is provided with a holder 211 for installing an integrated circuit board. When not covered or shielded, a toner injecting port 212 provided on the top wall 210 directly connects the chamber of the toner tank 201 and the external environment. The toner injecting port 212 is sealed by a removable or detachable toner injecting cap 213. After the toner injecting port 212 is sealed by the toner injecting cap 213, if the top wall 210 is not covered by other objects, the toner cartridge 200 can be installed into the laser printer.

INDUSTRIAL APPLICABILITY

With respect to the problem that a toner cartridge cannot be sufficiently utilized due to excessive residual toner left in a toner tank of the toner cartridge, two inner surfaces of the toner tank of the toner cartridge provided by the present invention, arranged to be parallel with a direction in which the toner cartridge is installed into the printer and in a transverse direction, are disposed in the form of planes extending along the vertical direction. Using such a configuration, since the two transverse inner surfaces at the upper portion of the toner tank are in the form of vertical walls, which cannot provide a supporting platform to toner, when the toner cartridge is installed in a laser printer, the toner will directly deposit to the position of toner supplying section due to its own gravity without any obstacles. In addition, by directly placing the integrated circuit board on the outer wall which is arranged at an upper portion in the vertical direction of the toner tank, and by adopting a structure with a top cap removed, a volume of the toner tank for storing toner can be expanded.

The invention claimed is:

1. A toner cartridge comprising a toner tank for storing fresh toner and a waste toner tank for storing waste toner obtained after development, wherein when the toner cartridge is installed in a laser printer, the toner tank has a toner supplying section at a lower portion in a vertical direction thereof for supplying toner to an external environment, characterized in that: two inner surfaces of the toner tank, arranged in a transverse direction of the toner tank and parallel with a direction in which the toner cartridge is installed into the laser printer, keep in a plane state at positions higher than the toner supplying section and are parallel with the vertical direction.

2. The toner cartridge according to claim 1, wherein an outer wall of the toner tank, arranged at an upper portion in the vertical direction of the toner tank and parallel with the direction in which the toner cartridge is installed into the laser printer, is provided with a holder for installing an integrated circuit board; a toner injecting port at a top wall of the toner tank, arranged at the upper portion in the vertical direction and parallel with the direction in which the toner cartridge is installed into the laser printer, directly connects a chamber of the toner tank and the external environment, and is sealed by a removable toner injecting cap.

* * * * *